US005735296A

United States Patent [19]

Chen

[11] Patent Number: 5,735,296

[45] Date of Patent: Apr. 7, 1998

[54] HAIR HOLDER

[76] Inventor: Chin-Chin Chen, No. 48, Dwan Ming Street, Kaohsiung, Taiwan

[21] Appl. No.: 859,223

[22] Filed: May 19, 1997

[51] Int. Cl.[6] ..... A45D 8/20

[52] U.S. Cl. ..... 132/277; 132/279; 132/282; 132/132; 132/156

[58] Field of Search ..... 132/277, 275, 132/276, 278, 279, 282, 132, 133, 134, 138, 151, 156

[56] References Cited

U.S. PATENT DOCUMENTS

| | | | |
|---|---|---|---|
| 1,194,844 | 8/1916 | Kalinowska | 132/277 |
| 2,166,460 | 7/1939 | Burns | 132/277 |
| 2,540,042 | 1/1951 | Craigen et al. | 132/276 |
| 2,549,193 | 4/1951 | Grison | 132/276 |
| 5,549,127 | 8/1996 | Chang | 132/277 |
| 5,642,740 | 7/1997 | Chen | 132/277 |

*Primary Examiner*—Gene Mancene

*Assistant Examiner*—Pedro Philogene

*Attorney, Agent, or Firm*—Larson & Taylor

[57] ABSTRACT

A hair holder includes a pair of bodies each including a mediate portion pivotally coupled together by a pivot shaft. Each body includes a number of teeth formed on a lower portion thereof. Each body further includes an extension plate extending from the mediate portion thereof, each extension plate including a notch defined in a mediate section thereof, thereby defining two spaced ears. A pin is fixedly mounted between the ears. A spring is provided for biasing the extension plates away from each other and for biasing the teeth toward each other. A cover plate is removably attached to the bodies. The cover plate includes a flexible mediate section having a gap defined in an underside thereof, thereby allowing the cover plate to be bendable along the flexible mediate section. The cover plate further includes a flexible engaging member formed on each of two sides of the underside thereof, each engaging member including a longitudinal recess defined in an underside thereof for fittingly, pivotally, releasably receiving an associated pin.

4 Claims, 5 Drawing Sheets

HAIR HOLDER

BACKGROUND OF THE INVENTION

1. Field of the Invention

The present invention relates to an improved hair holder including a cover plate which can be easily, removably attached thereto.

2. Description of the Related Art

Applicant's U.S. patent application Ser. No. 08/547,598 discloses a hair holder which includes a cover plate to shield the spring for aesthetic purpose as well as safety purpose. Nevertheless, assembly of the cover plate to the hair holder is time-consuming. The present invention is intended to provide an improved design in this regard which mitigates and/or obviates the above problem.

SUMMARY OF THE INVENTION

In accordance with one aspect of the invention, a hair holder comprises:

a pair of bodies each including a mediate portion pivotally coupled together by a pivot shaft, each body including a number of teeth formed on a lower portion thereof, each body further including an extension plate extending from the mediate portion thereof, each extension plate including a notch defined in a mediate section thereof, thereby defining two spaced ears, a pin being fixedly mounted between the ears, means for biasing the extension plates away from each other and for biasing the teeth toward each other, and a cover plate removably attached to the bodies, the cover plate including a flexible mediate section having a gap defined in an underside thereof, thereby allowing the cover plate to be bendable along the flexible mediate section, the cover plate further including a flexible engaging member formed on each of two sides of the underside thereof, each engaging member including a longitudinal recess defined in an underside thereof for fittingly, pivotally, releasably receiving an associated pin.

Preferably, each longitudinal recess includes a reduced opening having a width slightly less than a diameter of the associated pin.

In accordance with another aspect of the invention, a hair holder comprises:

a pair of bodies each including a mediate portion pivotally coupled together by a pivot shaft, each body including a number of teeth formed on a lower portion thereof, each body further including an extension plate extending from the mediate portion thereof, each extension plate including at least two spaced notches defined in a mediate section thereof, thereby defining at least three spaced ears, in which each of two mutually faced walls respectively of two adjacent ears includes a knurl formed thereon, means for biasing the extension plates away from each other and for biasing the teeth toward each other, and a cover plate removably attached to the bodies, the cover plate including a flexible mediate section having a gap defined in an underside thereof, thereby allowing the cover plate to be bendable along the flexible mediate section, the cover plate further includes at least two spaced flexible engaging members respectively formed on each of two sides of the underside thereof, each engaging member including a depression defined in each of two sides thereof for fittingly, releasably, pivotally receiving an associated knurl, each side of each engaging member further including a guiding groove defined in a distal end thereof and communicating with an associated depression, thereby guiding an associated knurl to slide into the associated depression via the associated guiding groove, the guiding groove having a width slightly less than a diameter of the associated knurl.

The cover plate may include two half sections respectively, pivotally, removably attached to the ears of the bodies.

Other objects, advantages, and novel features of the invention will become more apparent from the following detailed description when taken in conjunction with the accompanying drawings.

DESCRIPTION OF THE PREFERRED EMBODIMENTS

Figure 1:
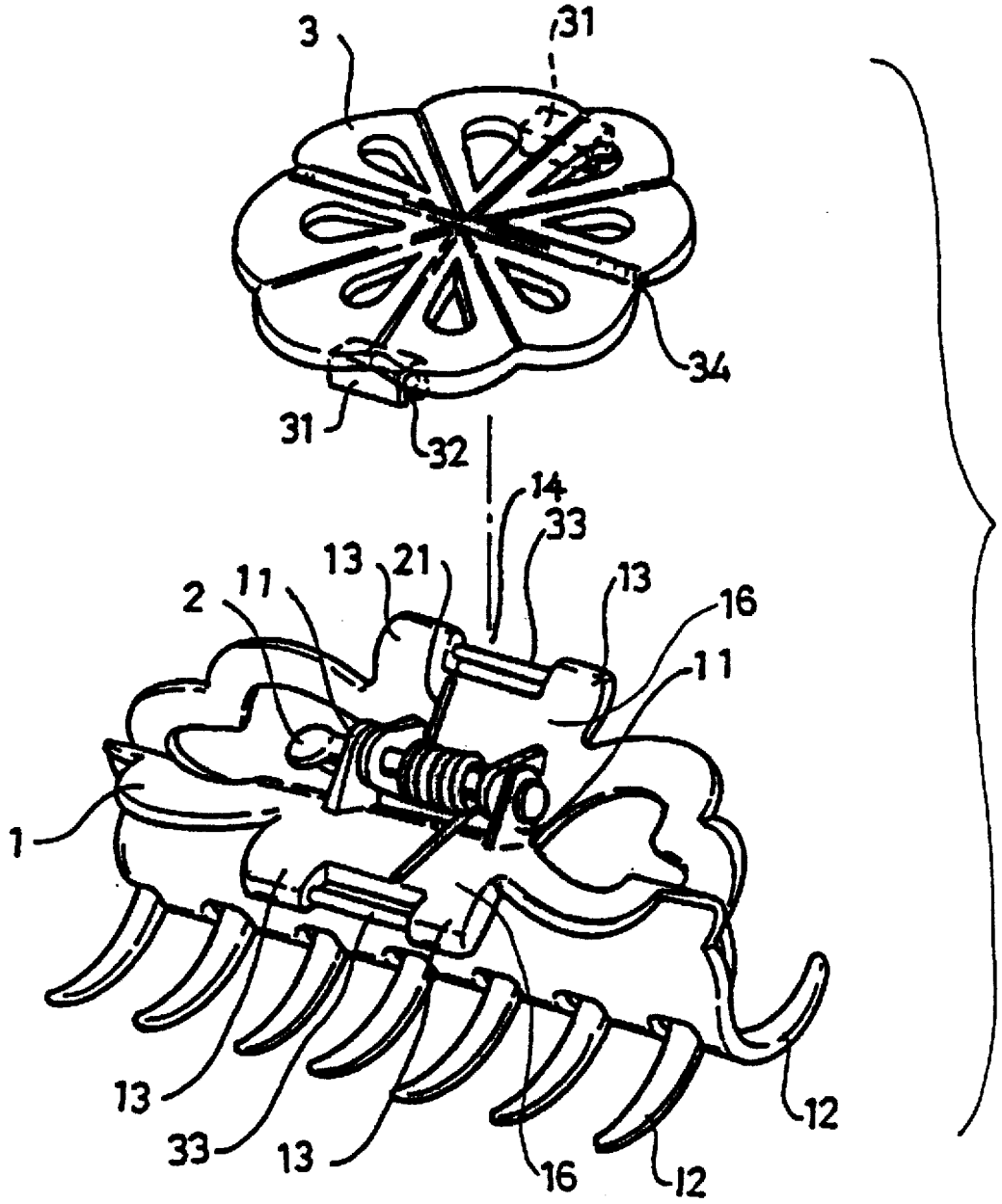
FIG. 1 is an exploded perspective view of a hair holder in accordance with the present invention.

Referring to the drawings and initially to FIGS. 1 to 4, a hair holder in accordance with the present invention generally comprises a pair of bodies 1 each including a mediate portion having a pair of lugs 11 extended therefrom and pivotally coupled together by a pivot shaft 2. Each body 1 includes a number of teeth or bristle elements 12 formed on the lower portion thereof for engaging with the hair. Each body 1 further includes an extension plate 16 (FIG. 1) extending from the mediate portion thereof, and a notch 14 is defined in a mediate section of the extension plate 16, thereby defining two spaced ears 13. In addition, a pin 33 is fixedly mounted between the ears 13. The pin 33 may be integrally formed with the associated body 1. A spring 21 is engaged on the pivot shaft 2 and engaged with the extension plates 16 for biasing the extension plates 16 toward each other so as to engage with the hair. The teeth 12 of the bodies 1 may be separated from each other when the bodies 1 are forced toward each other by the users.

Figure 2:
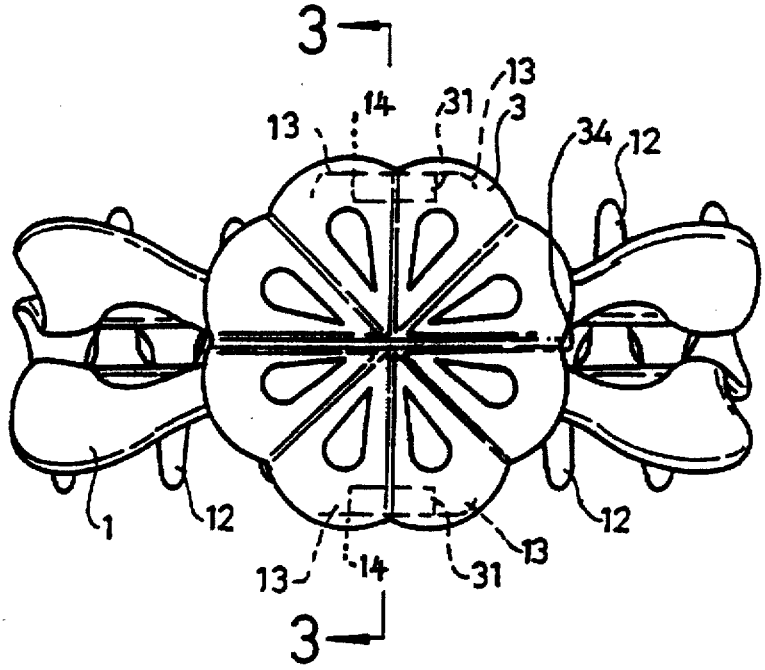
FIG. 2 is a top view of the hair holder.
Figure 3:
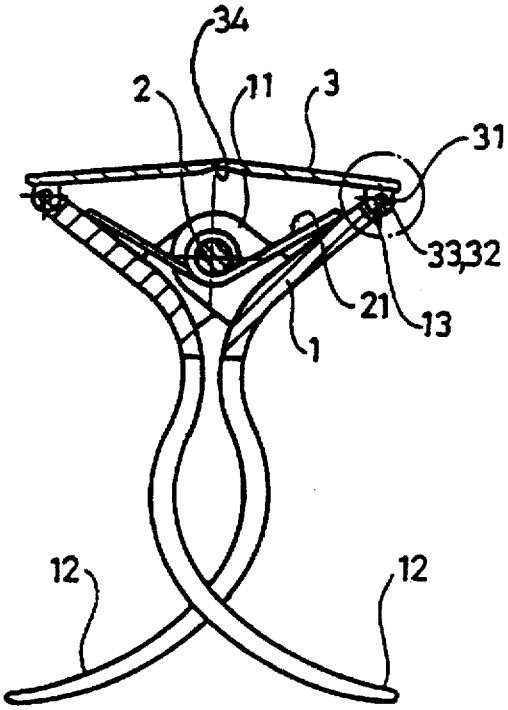
FIG. 3 is a cross sectional view taken along line 3—3 in FIG. 2.
Figure 4:
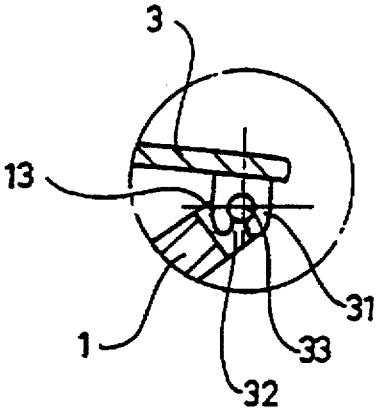
FIG. 4 is an enlarged view of a circle in FIG. 3.

The hair holder further includes a cover plate 3 removably attached to the bodies 1. The cover plate 3 includes a flexible mediate section having a gap 34 defined in an underside thereof, thereby allowing the cover plate 3 to be bendable along the flexible mediate section during separation of the teeth 12 (FIG. 1). The cover plate 3 further includes an engaging member 31 formed on each of two sides of the underside thereof. Each engaging member 31 includes a longitudinal recess 32 defined in an underside thereof for fittingly, releasably receiving an associated pin 33, in which the recess 32 includes a reduced opening having a width slightly less than a diameter of the associated pin 33. It is appreciated that the engaging members 31 are flexible to allow force-fitted insertion of the pins 33 into the recesses 32 of the cover plate 3, yet pivotal movements of the pins 33 are still allowable (FIGS. 3 and 4). The cover plate 3 may be of any desired shapes with any desired patterns thereon. As shown in FIG. 2, the cover plate 3 may shield the spring 21, the lugs 11, and the pivot shaft 2, thereby providing an aesthetic outline.

Figure 5:
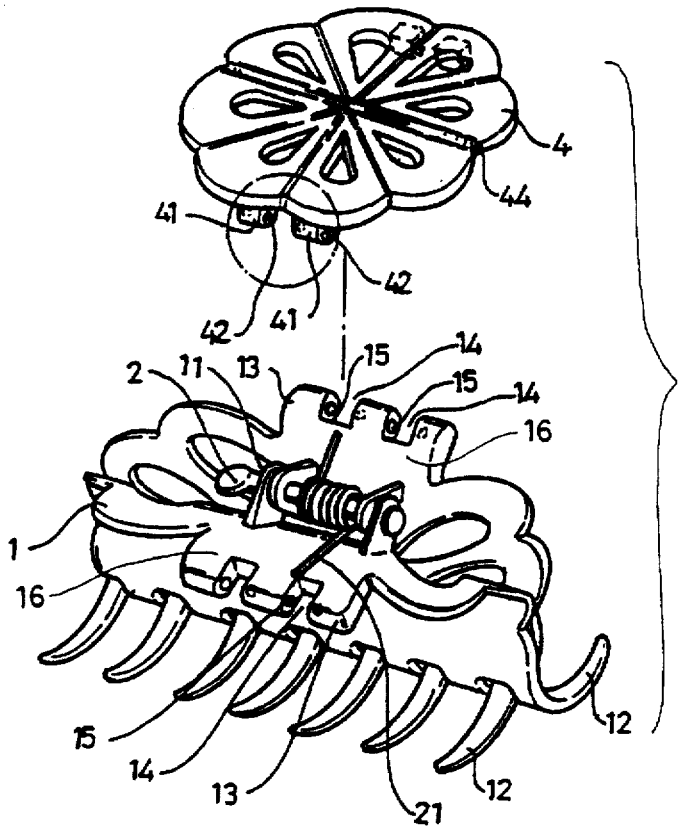
FIG. 5 is an exploded perspective view of a second embodiment of a hair holder in accordance with the present invention.
Figure 6:
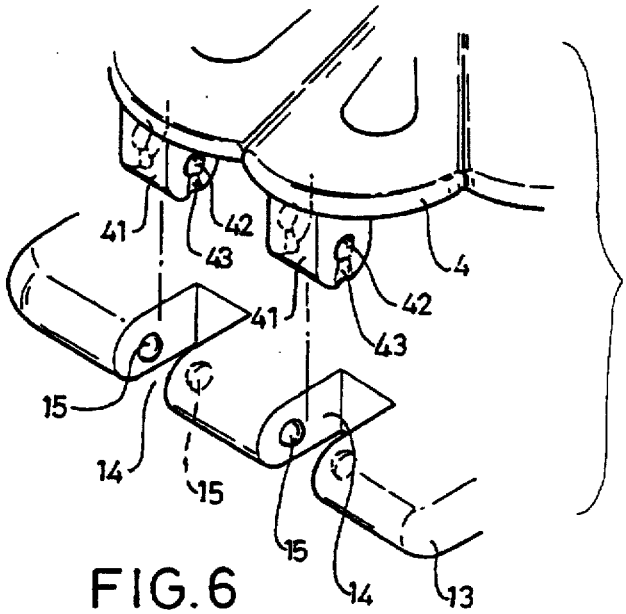
FIG. 6 is an enlarged view of a circle in FIG. 5 and a portion of a hair clip.
Figure 7:
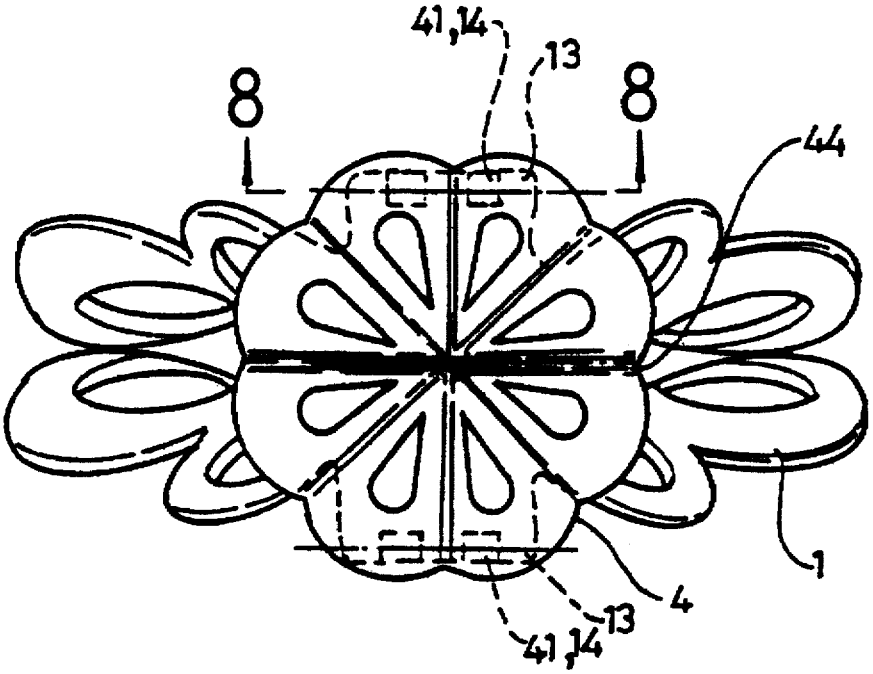
FIG. 7 is a top view of the hair holder in FIG. 5.
Figure 8:
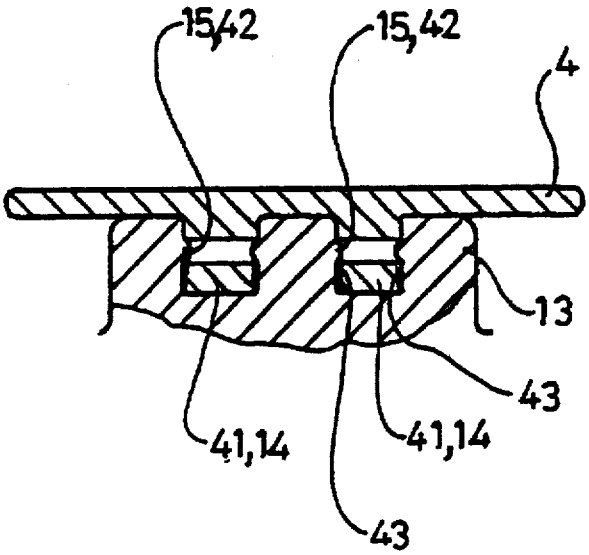
FIG. 8 is a sectional view taken along line 8—8 in FIG. 7.

Referring to FIGS. 5 to 8, a second embodiment of a hair holder in accordance with the present invention is shown, in which the extension plate 16 of each body 1 includes two spaced notches 14 which define three spaced ears 13 and in which each of two mutually faced walls respectively of two adjacent ears 13 includes a knurl 15 formed thereon. The cover plate, now designated as reference numeral "4", includes a flexible mediate section having a gap 44 defined in an underside thereof, thereby allowing the cover plate 4 to be bendable along the flexible mediate section during separation of the teeth 12 (FIG. 5). The cover plate 4 further includes a pair of spaced engaging members 41 respectively formed on each of two sides of the underside thereof. As shown in FIG. 6, each engaging member 41 includes a depression 42 defined in each of two sides thereof for fittingly, releasably receiving an associated knurl 15, in which each side of each engaging member 41 includes a guiding groove 43 defined in a distal end thereof and communicating with an associated depression 42, thereby guiding an associated knurl 15 to slide into the associated depression 42 via the associated guiding groove 43. It is appreciated that the engaging member 41 is flexible to allow force-fitted insertion of the hurls 15 into the depressions 42, yet the guiding groove 43 has a width slightly less than a diameter of the associated knurl 15 to prevent inadvertent removal of the knurls 15 from the depressions 42. It is further appreciated that pivotal movements of the knurls 15 in the depressions 42 are still allowable (FIG. 8). The cover plate 3 may be of any desired shapes with any desired patterns thereon. As shown in FIG. 7, the cover plate 4 may shield the spring 21, the lugs 11, and the pivot shaft 2, thereby providing an aesthetic outlook.

Figure 9:
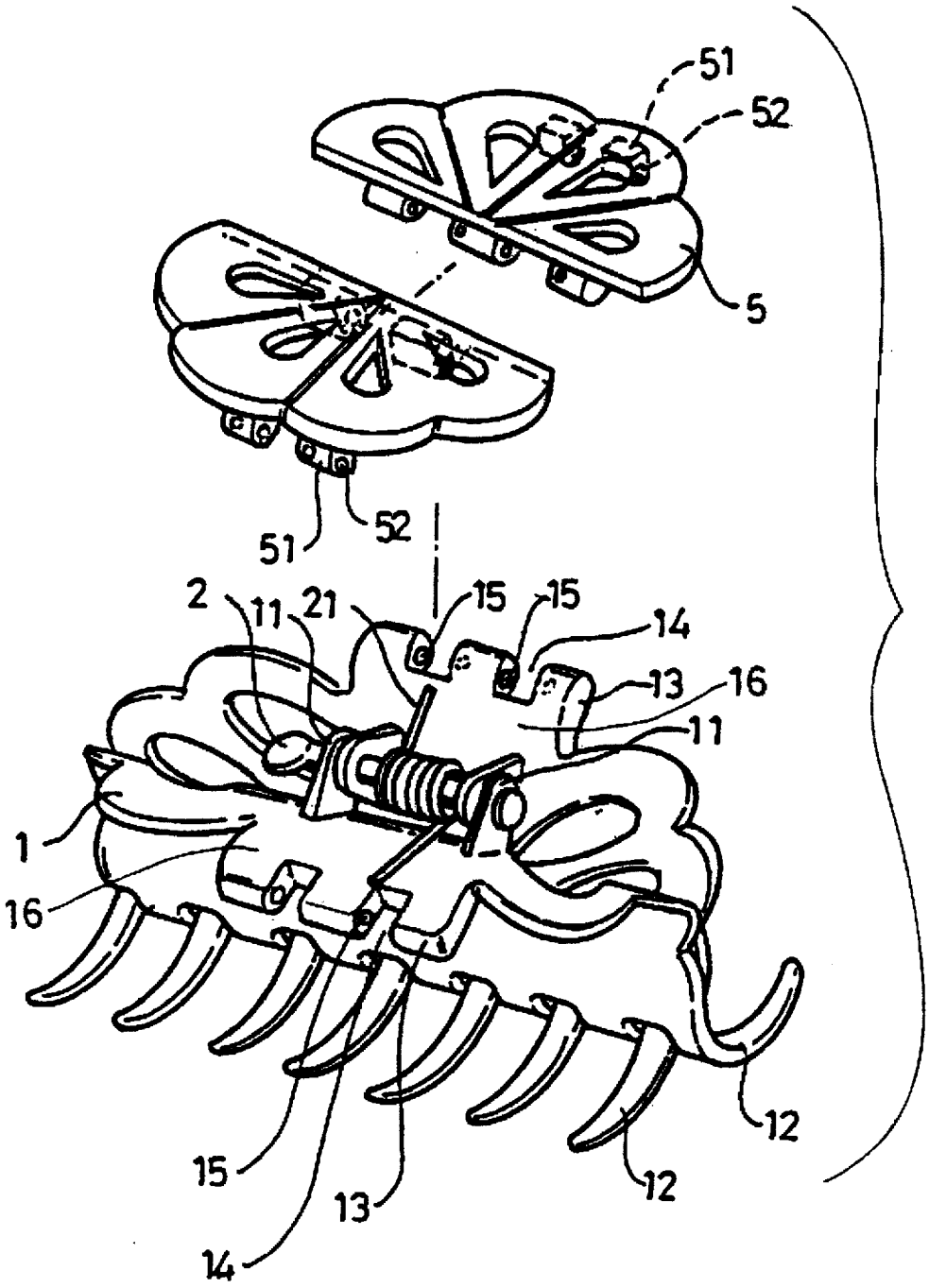
FIG. 9 is an exploded perspective view illustrating a modified embodiment of the hair holder.

FIG. 9 illustrates a modified embodiment of the second embodiment in FIG. 8, in which the cover plate, now designated as reference numeral "5" and the leading reference character "4" in FIG. 8 has now been replaced with "5", includes two half sections which can be pivotally, removably attached to the ears 13 of the bodies 1.

Thus, the present invention provides a cover plate which can be easily, pivotally, removably attached to the bodies of the hair holder to provide an aesthetic view.

Although the invention has been explained in relation to its preferred embodiment, it is to be understood that many other possible modifications and variations can be made without departing from the spirit and scope of the invention as hereinafter claimed.

What is claimed is:

1. A hair holder, comprising:

a pair of bodies each including a mediate portion pivotally coupled together by a pivot shaft, each said body including a number of teeth formed on a lower portion thereof, each said body further including an extension plate extending from the mediate portion thereof, each said extension plate including a notch defined in a mediate section thereof, thereby defining two spaced ears, a pin being fixedly mounted between the ears, means for biasing said extension plates away from each other and for biasing said teeth toward each other, and a cover plate removably attached to the bodies, the cover plate including a flexible mediate section having a gap defined in an underside thereof, thereby allowing the cover plate to be bendable along the flexible mediate section, the cover plate further including a flexible engaging member formed on each of two sides of the underside thereof, each said engaging member including a longitudinal recess defined in an underside thereof for fittingly, pivotally, releasably receiving an associated pin.

2. The hair holder according to claim 1, wherein each said longitudinal recess includes a reduced opening having a width slightly less than a diameter of the associated pin.

3. A hair holder, comprising:

a pair of bodies each including a mediate portion pivotally coupled together by a pivot shaft, each said body including a number of teeth formed on a lower portion thereof, each said body further including an extension plate extending from the mediate portion thereof, each said extension plate including at least two spaced notches defined in a mediate section thereof, thereby defining at least three spaced ears, in which each of two mutually faced walls respectively of two adjacent said ears includes a knurl formed thereon, means for biasing said extension plates away from each other and for biasing said teeth toward each other, and a cover plate removably attached to the bodies, the cover plate including a flexible mediate section having a gap defined in an underside thereof, thereby allowing the cover plate to be bendable along the flexible mediate section, the cover plate further includes at least two spaced flexible engaging members respectively formed on each of two sides of the underside thereof, each said engaging member including a depression defined in each of two sides thereof for fittingly, releasably, pivotally receiving an associated said knurl, each said side of each said engaging member further including a guiding groove defined in a distal end thereof and communicating with an associated said depression, thereby guiding an associated said knurl to slide into the associated depression via the associated guiding groove, the guiding groove having a width slightly less than a diameter of the associated knurl.

4. The hair holder according to claim 3, wherein the cover plate includes two half sections respectively, pivotally, removably attached to the ears of the bodies.

* * * * *